US008983354B2

(12) United States Patent
Shimizu

(10) Patent No.: US 8,983,354 B2
(45) Date of Patent: Mar. 17, 2015

(54) LASER FIXING DEVICE AND IMAGE FORMING APPARATUS

(71) Applicant: Fuji Xerox Co., Ltd., Tokyo (JP)

(72) Inventor: Osamu Shimizu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 143 days.

(21) Appl. No.: 13/869,400

(22) Filed: Apr. 24, 2013

(65) Prior Publication Data

US 2014/0105660 A1 Apr. 17, 2014

(30) Foreign Application Priority Data

Oct. 15, 2012 (JP) ..... 2012-228166

(51) Int. Cl.
*G03G 15/20* (2006.01)

(52) U.S. Cl.
CPC ..... *G03G 15/2007* (2013.01)
USPC ..... 399/336

(58) Field of Classification Search
USPC ..... 399/336, 337
See application file for complete search history.

(56) References Cited

U.S. PATENT DOCUMENTS

| | | | | |
|---|---|---|---|---|
| 8,260,185 | B2 * | 9/2012 | Matsubara et al. | 399/336 |
| 8,285,186 | B2 * | 10/2012 | Matsubara et al. | 399/336 |
| 8,750,777 | B2 * | 6/2014 | Matsubara et al. | 399/336 |
| 2011/0222935 | A1 | 9/2011 | Egusa et al. | |

FOREIGN PATENT DOCUMENTS

| | | |
|---|---|---|
| JP | A-2011-107658 | 6/2011 |
| JP | A-2011-191426 | 9/2011 |

* cited by examiner

*Primary Examiner* — William J Royer
(74) *Attorney, Agent, or Firm* — Oliff PLC

(57) ABSTRACT

A fixing device includes an irradiation section that has plural light emitting elements arranged in a first direction and emits light, a condensing section that condenses the light emitted from the irradiation section in a second direction intersecting the first direction, and a supporter that includes a contact location which supports a recording medium by a surface thereof at a position of a focal length of the condensing section, and a noncontact location which is located outside the contact location in the first direction and has a surface which does not come into contact with the recording medium, wherein a distance between the surface of the noncontact location and the condensing section is different from a distance between the surface of the contact location and the condensing section.

6 Claims, 13 Drawing Sheets

LASER FIXING DEVICE AND IMAGE FORMING APPARATUS

CROSS-REFERENCE TO RELATED APPLICATIONS

This application is based on and claims priority under 35 USC 119 from Japanese Patent Application No. 2012-228166 filed Oct. 15, 2012.

BACKGROUND (i) Technical Field

The present invention relates to a fixing device, and an image forming apparatus.

(ii) Related Art

In an image forming apparatus, there is a technique in which toner is irradiated with laser light and is thus fixed onto a recording medium.

SUMMARY

According to an aspect of the invention, there is provided a fixing device including: an irradiation section that has plural light emitting elements arranged in a first direction and emits light; a condensing section that condenses the light emitted from the irradiation section in a second direction intersecting the first direction; and a supporter that includes a contact location which supports a recording medium by a surface thereof at a position of a focal length of the condensing section, and a noncontact location which is located outside the contact location in the first direction and has a surface which does not come into contact with the recording medium, wherein a distance between the surface of the noncontact location and the condensing section is different from a distance between the surface of the contact location and the condensing section.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
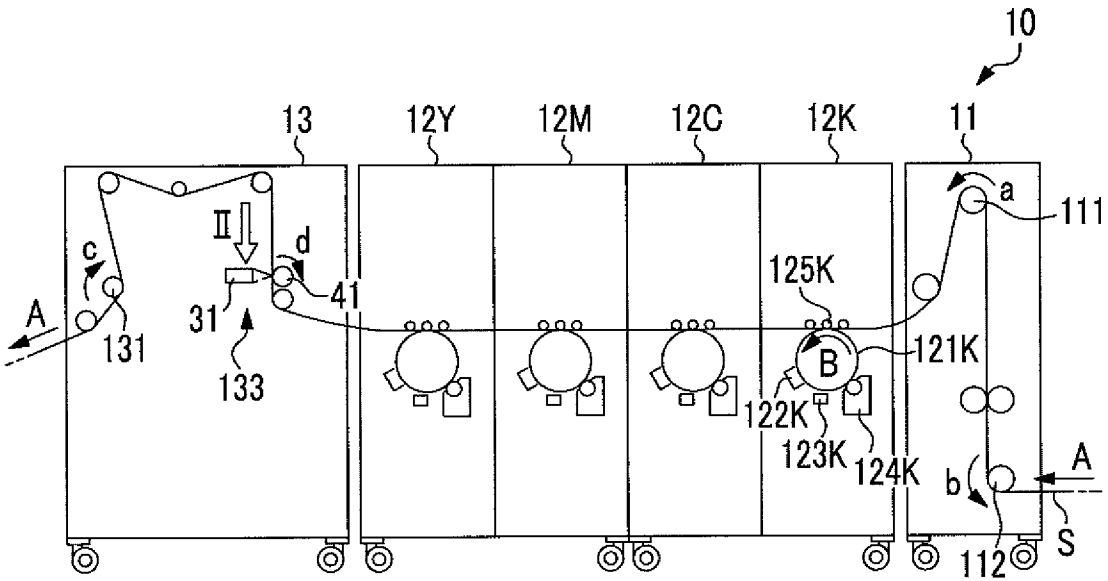
FIG. 1 is a diagram illustrating a configuration of an image forming apparatus according to a first exemplary embodiment.

FIG. 1 is a diagram illustrating a configuration of an image forming apparatus 10. The image forming apparatus 10 has a printer function, and forms an image on continuous paper S according to an electrophotographic method. The continuous paper S is used as a recording medium in the present exemplary embodiment. In addition, the image forming apparatus 10 may have a copy or a facsimile function in addition to the print function.

The image forming apparatus 10 includes an incorporation unit 11, image forming units 12Y, 12M, 12C and 12K, and a fixing unit 13. Plural rollers, which transport the continuous paper S in the arrow A direction in the figure when an image is formed, are provided inside each unit. A transport path of the continuous paper S is formed by these rollers or guide members (not shown). In FIG. 1, a shape of the transport path is shown by the continuous paper S which extends along the transport path.

The incorporation unit 11 incorporates the continuous paper S into the image forming apparatus 10 itself from a paper supply source (not shown). The incorporation unit 11 includes a drive roller 111, a back tension roller 112, motors (not shown) which are driving sources rotating the rollers, and plural rollers which rotate according to the transport of the continuous paper S. The drive roller 111 rotates in the arrow a direction in the figure when an image is formed and thereby transports the continuous paper S supplied from the paper supply source to the image forming units 12Y, 12M, 12C and 12K. The back tension roller 112 is provided further toward the upstream side than the drive roller 111 in the transport direction of the continuous paper S when an image is formed, and gives an appropriate tension to the continuous paper S by rotating in the arrow b direction such that the continuous paper S is transported on the transport path without being loosened.

The image forming units 12Y, 12M, 12C and 12K form toner images on the continuous paper S. The image forming units 12Y, 12M, 12C and 12K form images by respectively using yellow (Y), magenta (M), cyan (C) and black (K) toners. The image forming units 12Y, 12M, 12C and 12K are used as an image forming section in the present exemplary embodiment. Configurations of the image forming units 12Y, 12M, 12C and 12K are the same except that toner colors are different, and, thus, here, a configuration of the image forming unit 12K will be described as an example.

The image forming unit 12K includes a photoconductor drum 121K, a charging portion 122K, an exposure portion 123K, a developing portion 124K, and a transfer portion 125K. The photoconductor drum 121K is a cylindrical member in which photoconductive films are laminated on an outer circumferential surface. The photoconductor drum 121K rotates about an axis in the arrow B direction. The charging portion 122K uniformly charges the surface of the photoconductor drum 121K. The exposure portion 123K irradiates the photoconductor drum 121K with light corresponding to image data of K (black) so as to form an electrostatic latent image. The developing portion 124K develops the electrostatic latent image with the black toner so as to form a toner image on the surface of the photoconductor drum 121K. The transfer portion 125K transfers the toner image onto the continuous paper S.

The fixing unit 13 includes a sub-drive roller (or a discharge roller) 131 which is driven by a driver (not shown), a fixing device 133, and plural rollers which rotate according to the transport of the continuous paper S. The fixing device 133 irradiates the toner image transferred to the continuous paper S with laser light L so as to be fixed to the continuous paper S. The sub-drive roller 131 rotates in the arrow c direction and thereby transports the continuous paper S to outside of the image forming apparatus 10 in the arrow A direction. The continuous paper S discharged by the sub-drive roller 131 is wound by a paper winding device (not shown.). Alternatively, the discharged continuous paper S may be cut out and be accommodated in a stacker (not shown).

Figure 2:
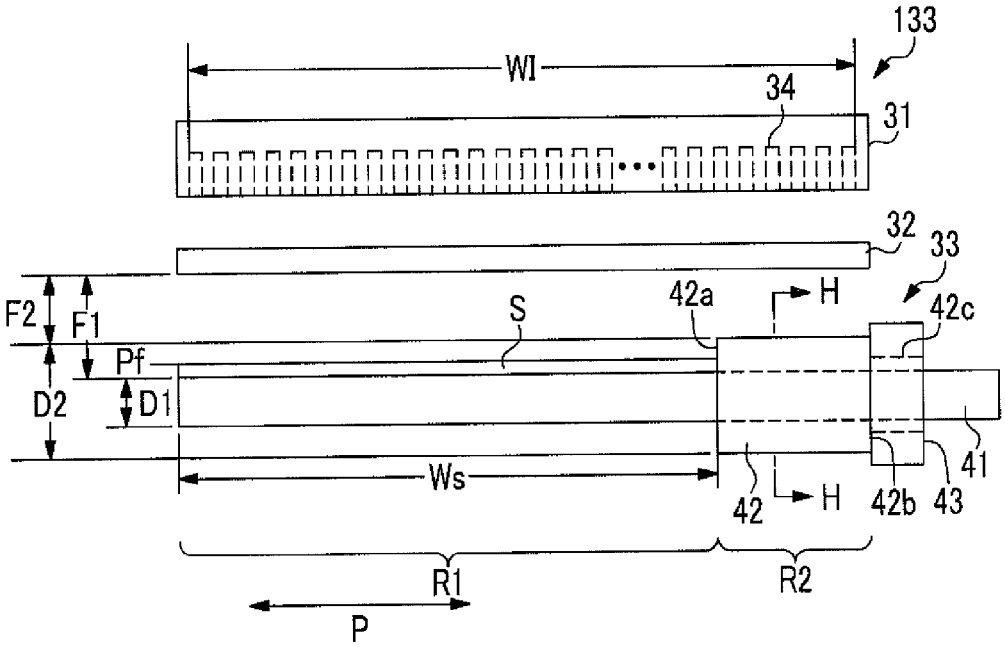
FIG. 2 is a diagram of a fixing device which is viewed from the II direction shown in FIG. 1.

FIG. 2 is a diagram of the fixing device 133 which is viewed from the II direction shown in FIG. 1. The fixing device 133 includes a laser array 31, a condensing lens 32, and a supporter 33. The laser array 31 irradiates the continuous paper S with laser light L with a predefined irradiation width WI. The laser array 31 is used as an irradiation section in the present exemplary embodiment. The laser array 31 includes plural light emitting elements 34 which are disposed so as to be arranged in a line in the width direction (the arrow P direction in the figure) of the continuous paper S. Each of the light emitting elements 34 is, for example, a semiconductor laser element, and applies the laser light L. The irradiation width WI of the laser array 31 has a length corresponding to the maximum paper width used in the image forming apparatus 10. Therefore, as shown in FIG. 2, when the width Ws of the continuous paper S is smaller than the maximum paper width, the laser array 31 applies the laser light L over the irradiation width WI greater than the width Ws of the continuous paper S. The condensing lens 32 is disposed between the laser array 31 and the supporter 33. The condensing lens 32 collects the laser light L applied from the laser array 31 at a predefined focal position Pf. The condensing lens 32 is used as a condensing section in the present exemplary embodiment.

The supporter 33 includes a transport roller 41, a covering member 42, and a locknut 43. The transport roller 41 is a cylindrical member made of a material such as aluminum. The transport roller 41 supports the continuous paper S at the focal position Pf. In other words, the transport roller 41 supports the continuous paper S at a position which is distant from the condensing lens 32 by a focal length F0 of the laser light L. The "focal length F0" refers to a distance at which the intensity of the laser light L is equal to or more than a threshold value. The threshold value corresponds to an intensity at which, for example, the toner is heated and melted. In addition, in relation to the "position which is distant by the focal length F0 of the laser light L", all the laser light beams L applied to the continuous paper S are not necessarily focused, and some of the laser light beams L may be deviated from the focal length F0. The transport roller 41 is used as a cylindrical member in the present exemplary embodiment. The transport roller 41 is rotated about an axis in the arrow d direction shown in FIG. 1 by a driving portion (not shown). Thereby, the transport roller 41 supports and transports the continuous paper S to the sub-drive roller 131. The transport roller 41 has a length which is equal to or more than the maximum width of the continuous paper S. Therefore, as shown in FIG. 2, when the width Ws of the continuous paper S is smaller than the maximum paper width, the transport roller 41 has a part which comes into contact with the continuous paper S and a part which does not come into contact with the continuous paper S.

The covering member 42 is a cylindrical and hollow member which is made of a material such as aluminum in the same manner as the transport roller 41. The covering member 42 covers an outer circumferential surface of the part which does not come into contact with the continuous paper S in the transport roller 41. The diameter D2 of the covering member 42 is greater than the diameter D1 of the transport roller 41. Therefore, the distance F2 between the surface of the covering member 42 and the condensing lens 32 is smaller than the distance F1 between the surface of the transport roller 41 and the condensing lens 32. In addition, an end surface 42*a* of the covering member 42 functions as an edge guide for aligning a position of the side end of the continuous paper S. The locknut 43 is made of a material such as aluminum, and locks and fixes the covering member 42.

As shown in FIG. 2, the supporter 33 has a contact location R1 in which the continuous paper S is on the surface region where a light density is equal to or more than a threshold value and a noncontact location R2 in which there is no continuous paper S. In the present exemplary embodiment, the part which comes into contact with the continuous paper S in the transport roller 41 is the contact location R1. In addition, the part which does not come into contact with the continuous paper S in the transport roller 41 and the covering member 42 are the noncontact location R2.

Figure 3:
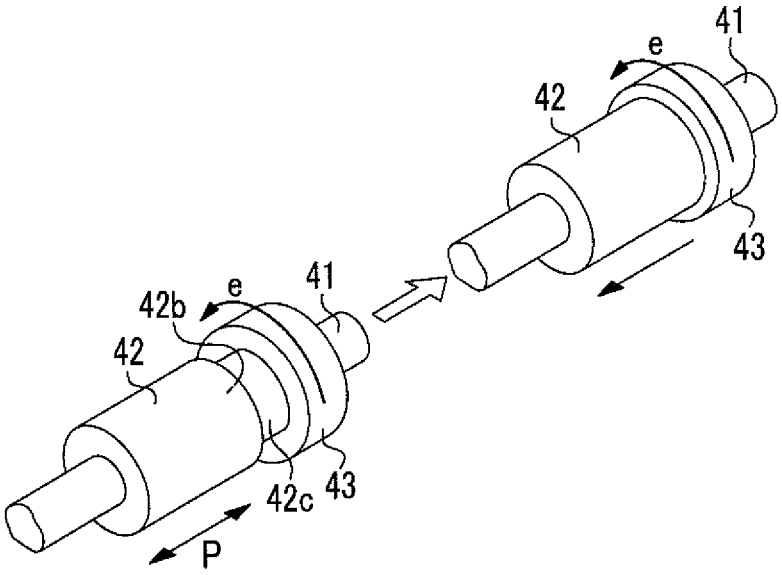
FIG. 3 is a diagram illustrating a method of installing a covering member.

FIG. 3 is a diagram illustrating a method of installing the covering member 42. A worker fits the covering member 42 to the transport roller 41, and moves the covering member 42 to the position where the end surface 42*a* shown in FIG. 2 comes into contact with the side end of the continuous paper S. A protrusion 42*c* which has a C shape in the cross-sectional view is provided in an end surface 42*b* of the covering member 42. After moving the covering member 42, the worker rotates the locknut 43 in the arrow a direction in the figure and fits the locknut 43 and the protrusion 42*c* to each other. Thereby, the protrusion 42*c* is locked, and the covering member 42 is fixed.

In addition, in a case where a paper width of the continuous paper S is changed, the covering member 42 is required to be moved according to the changed paper width. In this case, the worker rotates the locknut 43 in an opposite direction to the arrow e direction in the figure so as to be loosened, and separates the locknut 43 from the protrusion 42*c*. After separating the locknut 43, the worker moves the covering member 42 in the length direction of the transport roller 41. The worker moves the covering member 42 to a position where the end surface 42*a* shown in FIG. 2 comes into contact with the side end of the changed continuous paper S in the longitudinal direction, and then fits the locknut 43 and the protrusion 42*c* while rotating the locknut 43 in the arrow e direction in the figure. Thereby, the protrusion 42*c* is locked, and the covering member 42 is fixed.

Figure 4:
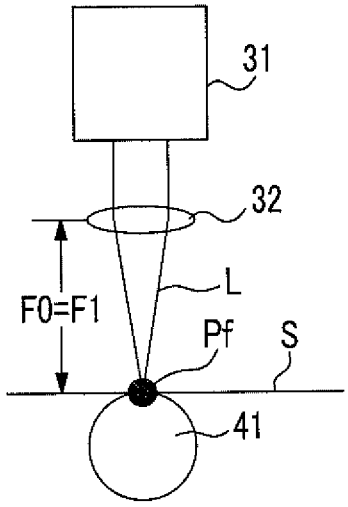
FIG. 4 is a diagram illustrating that a contact location is irradiated with laser light.

FIG. 4 is a diagram illustrating when the contact location R1 is irradiated with the laser light L. In addition, in FIG. 4, the covering member 42 and the locknut 43 are not shown. Since the continuous paper S is on the surface of the transport roller 41 which is a surface of the contact location R1, the laser light L is applied to the surface of the continuous paper S. A distance between the condensing lens 32 and the surface of the continuous paper S is substantially the distance F1 between the condensing lens 32 and the surface of the transport roller 41. As described above, the continuous paper S is supported at the focal position Pf, and thus the distance F1 between the condensing lens 32 and the surface of the continuous paper S is the same as the focal length PC of the laser light L. In this case, the laser light L is applied to the surface of the continuous paper S in a focused state. Thereby, the toner on the continuous paper S is heated and melted and is thus fixed to the continuous paper S.

Figure 5:
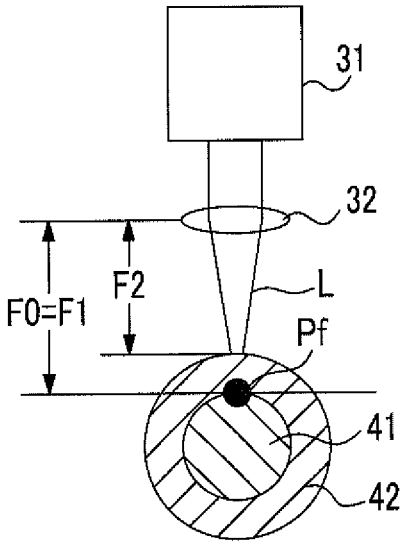
FIG. 5 is a diagram illustrating that a noncontact location is irradiated with laser light.

FIG. 5 is a diagram illustrating that the noncontact location R2 is irradiated with the laser light L. FIG. 5 is a cross-sectional view of the supporter 33 taken along the line H-H in FIG. 2. In addition, in FIG. 5, the locknut 43 is not shown. Since there is no continuous paper S on the covering member 42 which is a surface of the noncontact location R2, the laser light L is applied to the surface of the covering member 42. As described above, since the diameter D2 of the covering member 42 is greater than the diameter D1 of the transport roller 41, the distance F2 between the condensing lens 32 and the covering member 42 is smaller than the distance F1 between the condensing lens 32 and the surface of the transport roller 41, that is, the focal length F0 of the laser light L. In this case, the laser light L is applied to the surface of the covering member 42 in a defocused state.

If the covering member 42 is not provided, the distance F1 between the condensing lens 32 and the surface of the transport roller 41 is substantially the same as the focal length F0 of the laser light L, and thus the laser light L is applied to the surface of the transport roller 41 in a focused state. In this case, high heat is applied to the surface of the transport roller 41, and thus there is concern that the transport roller 41 may be thermally deformed or damaged. In contrast, in the present exemplary embodiment, since the laser light L is applied to the surface of the noncontact location R2 in a defocused state, a temperature of the noncontact location R2 is suppressed from being increased by the laser light L. As a result, thermal deformation or damage of the noncontact location R2 is prevented.

Second Exemplary Embodiment

The second exemplary embodiment is different from the first exemplary embodiment in a configuration of a fixing device 133A. In addition, the other configurations are the same as in the first exemplary embodiment and are thus given the same reference numerals, and detailed description thereof will be omitted.

Figure 6:
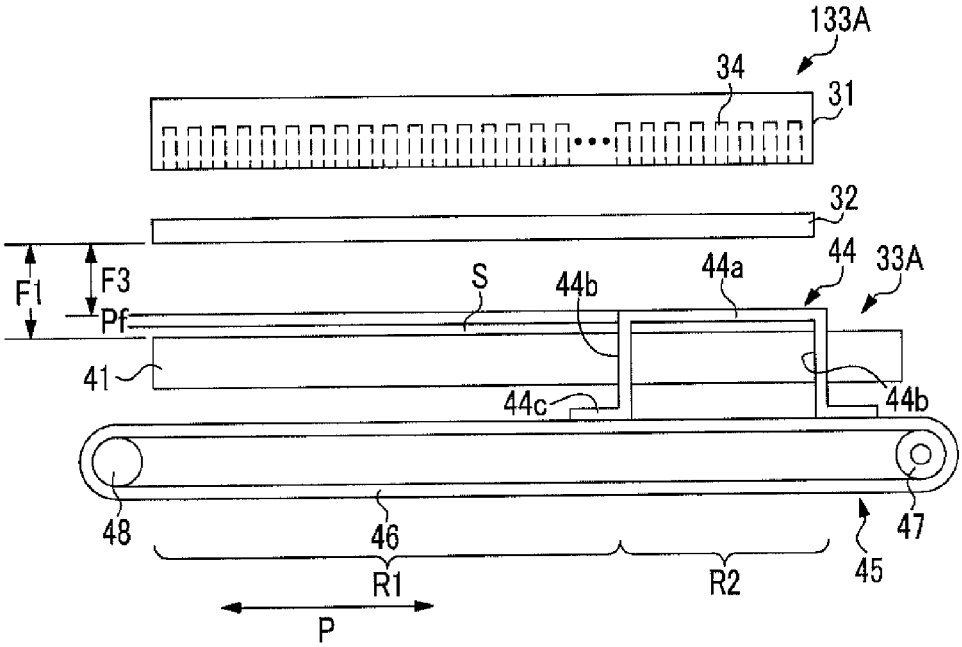
FIG. 6 is a diagram of a fixing device according to a second exemplary embodiment which is viewed from the II direction shown in FIG. 1.
Figure 7:
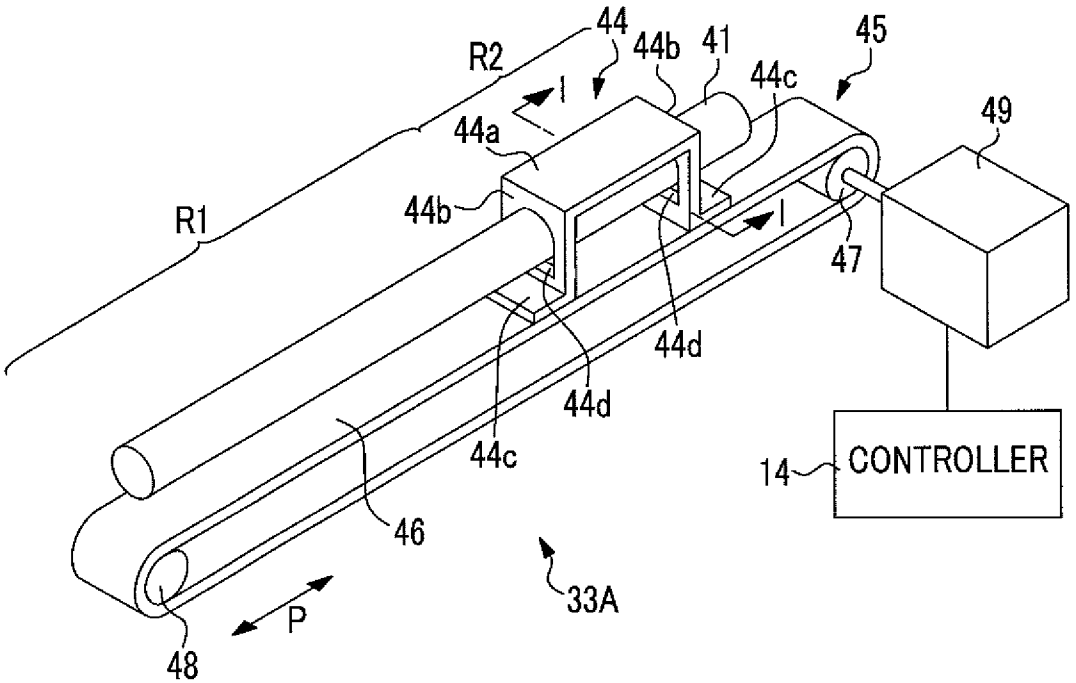
FIG. 7 is a perspective view of a supporter according to the second exemplary embodiment.

FIG. 6 is a diagram of the fixing device 133A which is viewed from the II direction shown in FIG. 1. The fixing device 133A includes a laser array 31 and a condensing lens 32 which are the same as in the first exemplary embodiment, and a supporter 33A. FIG. 7 is a perspective view of the supporter 33A. The supporter 33A includes a transport roller 41, a light blocking guide 44, and a transport portion 45. The light blocking guide 44 is made of a light blocking material. The light blocking guide 44 is used as a light blocking member in the present exemplary embodiment. The light blocking guide 44 includes an upper surface part 44*a*, a side surface part 44*b*, and a leg part 44*c*. The upper surface part 44*a* is provided between a part which does not come into contact with the continuous paper S in the transport roller 41 and the condensing lens 32, and blocks the laser light L from being applied to the part. As shown in FIG. 6, the upper surface part 44*a* is provided at a position closer to the condensing lens 32 than the surface of the transport roller 41, and thus a distance F3 between the surface of the upper surface part 44*a* and the condensing lens 32 is smaller than the distance F1 between the surface of the transport roller 41 and the condensing lens 32. Referring to FIG. 7 again, the side surface part 44*b* supports the upper surface part 44*a*. Holes 44*d* are provided in the side surface part 44*b*. The transport roller 41 is provided so as to penetrate through the holes 44*d*. The leg part 44*c* is fixed to a belt member 46 of the transport portion 45.

The transport portion 45 transports the light blocking guide 44 in the length direction (the arrow P direction) of the transport roller 41. The transport portion 45 includes the belt member 46, rollers 47 and 48, and a driving part 49. The belt member 46 is an endless belt-shaped member, and is hung over the rollers 47 and 48. The roller 47 is rotated by the driving part 49 such as a motor. Thereby, the roller 47 rotates the belt member 46. The roller 48 rotates according to the rotation of the belt member 46. As described above, the leg part 44*c* of the light blocking guide 44 is fixed to the belt member 46. Therefore, when the belt member 46 rotates, the light blocking guide 44 moves in the length direction of the transport roller 41.

A controller 14 controls driving of the driving part 49 and moves the light blocking guide 44 depending on a paper width of the continuous paper S. Specifically, the controller 14 moves the light blocking guide 44 to a position where the side surface part 44*b* of the light blocking guide 44 comes into contact with the side end of the continuous paper S, by using the driving part 49. A paper width of the continuous paper S may be input, for example, through an operation by a worker, and may be detected using a photosensor.

As shown in FIG. 6, the supporter 33A has a contact location R1 in which the continuous paper S on the surface region where a light density is equal to or more than a threshold value and a noncontact location R2 in which there is no continuous paper S. In the present exemplary embodiment, the part which comes into contact with the continuous paper S in the transport roller 41 is the contact location R1. In addition, the part which does not come into contact with the continuous paper S in the transport roller 41 and the light blocking guide 44 is the noncontact location R2.

Figure 8:
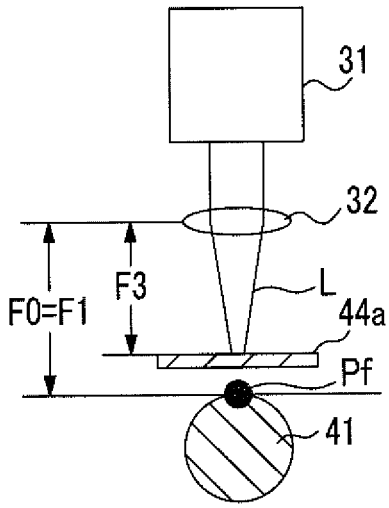
FIG. 8 is a diagram illustrating that a noncontact location according to the second exemplary embodiment is irradiated with laser light.

FIG. 8 is a diagram illustrating that the noncontact location R2 is irradiated with the laser light L. FIG. 8 is a cross-sectional view of the supporter 33A taken along the line I-I in FIG. 7. In addition, in FIG. 8, the transport portion 45 and the driving part 49 are not shown. Since there is no continuous paper S on the surface of the upper surface part 44*a* of the light blocking guide 44 which is a surface of the noncontact location R2, the laser light L is applied to the surface of the upper surface part 44*a*. Since the upper surface part 44*a* is provided at a position closer to the condensing lens 32 than the surface of the transport roller 41, the distance F3 between the surface of the upper surface part 44*a* and the condensing lens 32 is smaller than the distance F1 between the surface of the transport roller 41 and the condensing lens 32, that is, the focal length F0 of the laser light L. In this case, the laser light L is applied to the surface of the upper surface part 44*a* in a defocused state in the same manner as the above-described first exemplary embodiment, and thus the same effect as in the first exemplary embodiment can be achieved.

MODIFICATION EXAMPLES

The above-described exemplary embodiments are examples of the invention, and the invention is not limited to the exemplary embodiments. The above-described exemplary embodiments may be modified as follows. In addition, the following Modification Examples may be combined.

(1) Modification Example 1

Figure 9:
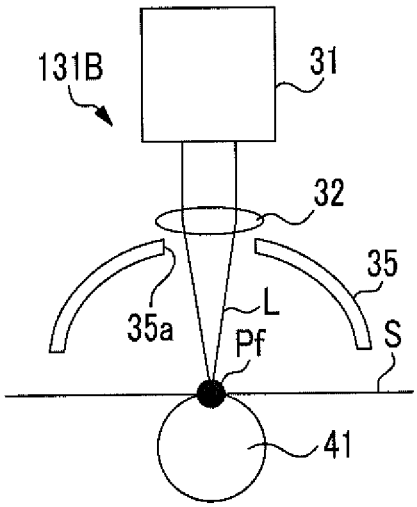
FIG. 9 is a diagram illustrating a configuration of a fixing device according to Modification Example 1.

In the second exemplary embodiment, the laser light L which is reflected by the continuous paper S or the laser light L which is applied to the light blocking guide 44 may be applied to the continuous paper S through reflection. FIG. 9 is a diagram illustrating a configuration of a fixing device 131B according to Modification Example 1. The fixing device 131B includes a semicircular reflection member 35 which is made of a material which reflects light. The reflection member 35 is provided so as to surround a region which is irradiated with the laser light L. An opening portion 35*a* is provided in an upper end of the reflection member 35. The laser array 31 irradiates the continuous paper S with the laser light L via the opening portion 35*a*. The laser light L applied from the laser array 31 is applied to the continuous paper S via the opening portion 35*a*. At this time, some of the laser light L applied to the continuous paper S is reflected by the continuous paper S. The reflection member 35 reflects the laser light L reflected by the continuous paper S so as to be applied to the continuous paper S again.

Figure 10:
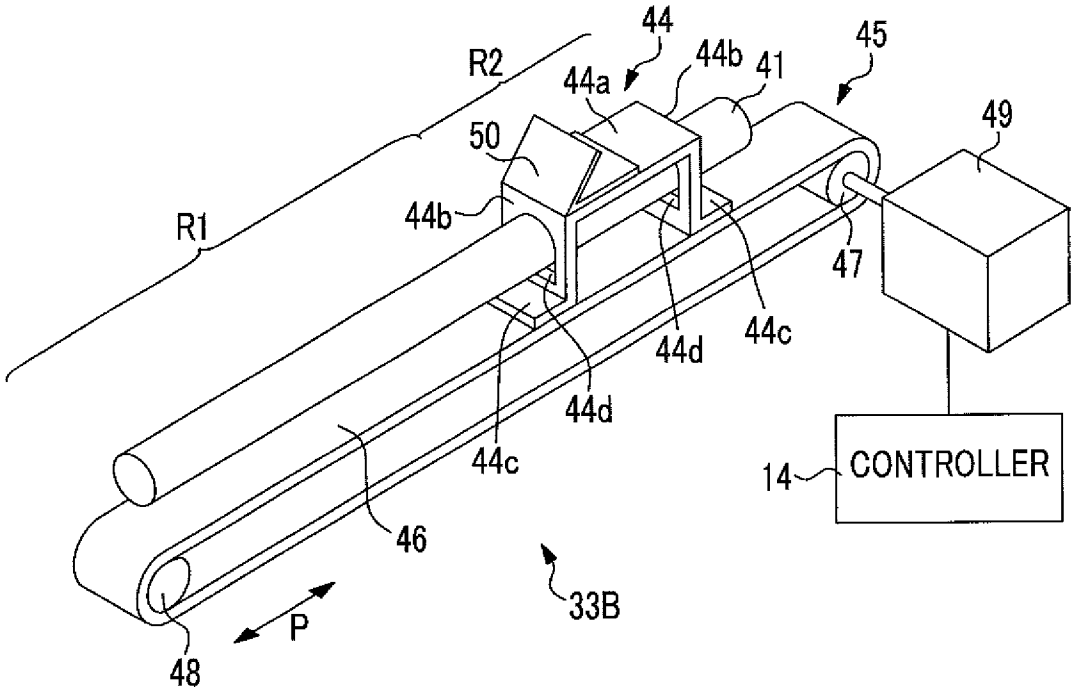
FIG. 10 is a perspective view of a supporter according to Modification Example 1.

FIG. 10 is a perspective view of a supporter 333 according to Modification Example 1. In the supporter 33B, a reflection plate 50 is provided in the light blocking guide 44. The reflection plate 50 is made of a material reflecting light and is disposed at the end of the upper surface part 44*a*. The reflection plate 50 reflects light which is applied to the noncontact location R2 from the laser array 31, toward the contact location R1 side.

Figure 11:
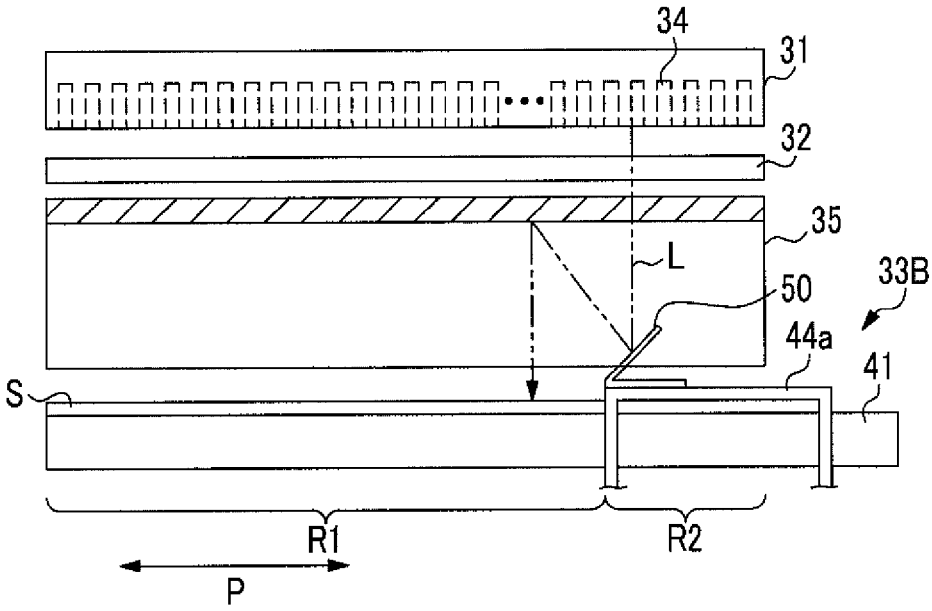
FIG. 11 is a diagram illustrating an operation of a reflection plate according to Modification Example 1.

FIG. 11 is a diagram illustrating an operation of the reflection plate 50. In Modification Example 1, the controller 14 controls the laser array 31 so as to turn on only the light emitting elements 34 corresponding to the contact location R1. Thereby, basically, the laser light L is applied to only the continuous paper S on the contact location RI. However, practically, it is difficult to completely match an irradiation width of the laser light L with a width of the continuous paper S. For this reason, even in a case where this control is performed, some of laser light L may be applied to the noncontact location R2. The reflection plate 50 plays a part of guiding the laser light L applied to the noncontact location R2, to the continuous paper S.

When the laser array 31 irradiates the noncontact location R2 with the laser light L, the reflection plate 50 reflects the laser light L toward the contact location R1 side. The light reflected by the reflection plate 50 is reflected by the reflection member 35 and is applied to the continuous paper S again. According to Modification Example 1, a light amount of the laser light L applied to the continuous paper S increases, and even the laser light L applied to the noncontact location R2 is appropriately used to fix a toner image.

(2) Modification Example 2

In the first exemplary embodiment, the covering member 42 is provided in the part which does not come into contact with the continuous paper S in the transport roller 41. Alternatively, the covering member 42 may be provided in the part which comes into contact with the continuous paper S in the transport roller 41. In this case, the covering member 42 supports the continuous paper S at the focal position Pf. In this Modification Example, the part which comes into contact with the continuous paper S in the transport roller 41 and the covering member 42 are the contact location R1. In addition, the part which does not come into contact with the continuous paper S in the transport roller 41 is the noncontact location R2.

Figure 12:
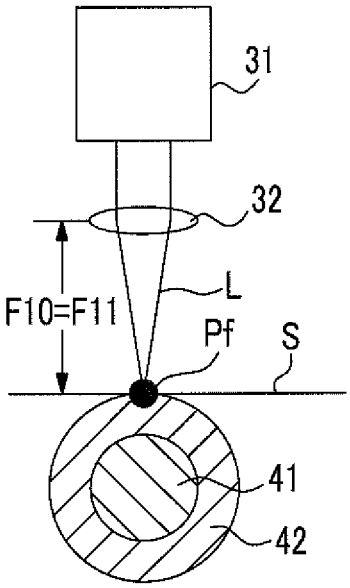
FIG. 12 is a diagram illustrating that a contact location is irradiated with laser light according to Modification Example 2.

FIG. 12 is a diagram illustrating that the contact location R1 is irradiated with the laser light L according to Modification Example 2. In addition, in FIG. 12, the locknut 43 is not shown. Since the continuous paper S is on the surface of the covering member 42 which is a surface of the contact location R1, the laser light L is applied to the surface of the continuous paper S. A distance between the condensing lens 32 and the continuous paper S is substantially a distance F11 between the condensing lens 32 and the surface of the covering member 42. As described above, the continuous paper S is supported at the focal position Pf, and thus the distance F11 between the condensing lens 32 and the surface of the continuous paper S is the same as the focal length F10 of the laser light L. In this case, the laser light L is applied to the surface of the continuous paper S in a focused state. Thereby, the toner on the continuous paper S is heated and melted and is thus fixed to the continuous paper S.

Figure 13:
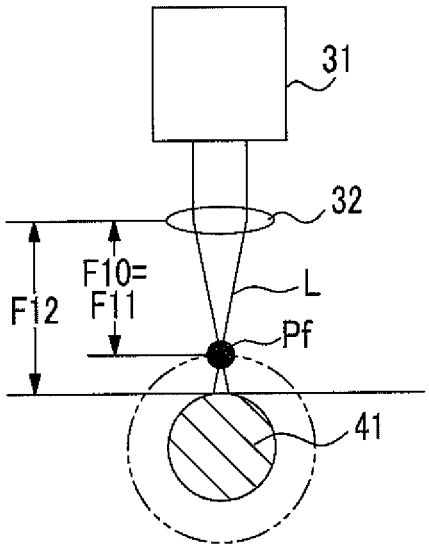
FIG. 13 is a diagram illustrating that a noncontact location according to Modification Example 2 is irradiated with laser light.

FIG. 13 is a diagram illustrating that the noncontact location R2 is irradiated with the laser light L according to Modification Example 2. FIG. 13 is a cross-sectional view of the supporter 33 taken along the line H-H in FIG. 2 in the same manner as FIG. 5. In addition, in FIG. 13, the locknut 43 is not shown. Since there is no continuous paper S on the transport roller 41 which is a surface of the noncontact location R2, the laser light L is applied to the surface of the transport roller 41. As described above, since the diameter D1 of the transport roller 41 is smaller than the diameter D2 of the covering member 42, the distance F12 between the condensing lens 32 and the surface of the transport roller 41 is greater than the distance F11 between the condensing lens 32 and the surface of the covering member 42, that is, the focal length F10 of the laser light L. In this case, the laser light L is applied to the surface of the transport roller 41 in a defocused state, and thus the same effects as in the above-described first exemplary embodiment can be achieved.

(3) Modification Example 3

In the second exemplary embodiment, the transport portion 45 transports the light blocking guide 44 by using a belt feeding mechanism. However, the transport portion 45 is not limited to using a belt feeding mechanism. For example, the transport portion 45 may transport the light blocking guide 44 by using a screw feeding mechanism.

(4) Modification Example 4

In the first and second exemplary embodiments, the controller 14 may control the laser array 31 so as to turn on only the light emitting elements 34 corresponding to the contact location R1 as in the above-described Modification Example 1. Thereby, basically, the laser light L is applied to only the continuous paper S on the contact location R1 from the laser array 31. However, practically, it is difficult to completely match an irradiation width of the laser light L with a width of the continuous paper S. For this reason, even in a case where this control is performed, some of laser light L may be applied to the noncontact location R2. Therefore, the invention may be appropriately carried out through a combination with this control.

(5) Modification Example 5

In the first and second embodiments, the reflection member 35 may be provided so as to surround a region which is irradiated with the laser light L as in the above-described Modification Example 1. Thereby, a light amount of the laser light L applied to the continuous paper S increases.

(6) Modification Example 6

In the first exemplary embodiment, the covering member 42 may be made of a material absorbing the laser light L. Similarly, in the second exemplary embodiment, the light blocking guide 44 may be made of a material absorbing the laser light L. Thereby, an influence of the laser light L exerted on the noncontact location R2 is further suppressed.

(7) Modification Example 7

In the first exemplary embodiment, the covering member 42 is provided in the transport roller 41, and thereby the distance F2 between the surface of the noncontact location R2 and the condensing lens 32 is different from the distance F1 between the surface of the contact location R1 and the condensing lens 32. However, for example, when a width of the continuous paper S is fixed, the contact location R1 and the noncontact location R2 do not vary. In this case, a shape of the transport roller 41 itself may be changed. For example, the transport roller 41 may be formed such that a diameter of the part which comes into contact with the continuous paper S in the transport roller 41 is greater or smaller than a diameter of the part which does not come into contact with the continuous paper S. In this case, the part which comes into contact with the continuous paper S in the transport roller 41 is the contact location R1, and the part which does not come into contact with the continuous paper S is the noncontact location R2.

(8) Modification Example 8

In the first and second embodiments, toner is used as a color material for forming an image. However, a color material is not limited to the toner. For example, a color material may be ink which is of a heated and melted type used for an ink jet method.

(9) Modification Example 9

In the first and second exemplary embodiments, the continuous paper S is used as a recording medium on which an image is formed. However, a recording medium is not limited to the continuous paper S. For example, a recording medium maybe a cut paper sheet which is cut out to a determined size in advance.

(10) Modification Example 10

In the first and second embodiments, the image forming apparatus 10 forms a color image, but may form a monochrome image. In this case, the image forming apparatus 10 may include only the image forming unit 12K among the image forming units 12Y, 12M, 120 and 12K.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an irradiation section that has a plurality of light emitting elements arranged in a first direction and emits light;

a condensing section that condenses the light emitted from the irradiation section in a second direction intersecting the first direction; and a supporter that includes a contact location which supports a recording medium by a surface thereof at a position of a focal length of the condensing section, and a noncontact location which is located outside the contact location in the first direction and has a surface which does not come into contact with the recording medium, wherein a distance between the surface of the noncontact location and the condensing section is different from a distance between the surface of the contact location and the condensing section.

2. The fixing device according to claim 1, wherein the supporter comprises:

a cylindrical member that supports the recording medium; and a covering member that covers an outer circumferential surface of a part which does not come into contact with the recording medium in the cylindrical member, wherein the surface of the contact location is a surface of the cylindrical member, and wherein the surface of the noncontact location is a surface of the covering member.

3. The fixing device according to claim 1, wherein the supporter comprises:

a cylindrical member that supports the recording medium;

a light blocking member that is provided between the cylindrical member and the condensing section, and blocks light from the irradiation section; and a transport section that transports the light blocking member so that the length of the light from the irradiation section to the cylindrical member in the first direction coincides with the width of the recoding medium, wherein the surface of the contact location is a surface of the cylindrical member, and wherein the surface of the noncontact location is a surface of the light blocking member.

4. The fixing device according to claim 3, further comprising:

a reflection plate that is provided in the light blocking member and reflects light applied to the light blocking member toward the contact location side.

5. The fixing device according to claim 1, wherein the supporter comprises:

a cylindrical member that supports the recording medium; and a covering member that covers an outer circumferential surface of apart which comes into contact with the recording medium in the cylindrical member, wherein the surface of the contact location is a surface of the covering member, and wherein the surface of the noncontact location is a surface of the cylindrical member.

6. An image forming apparatus comprising:

an image forming section that forms an image on a recording medium; and the fixing device according to claim 1 that fixes the image onto the recording medium.

* * * * *